United States Patent [19]

Miihkinen

[11] Patent Number: 4,951,392

[45] Date of Patent: Aug. 28, 1990

[54] SYNTHETIC PRESS ROLL FOR PAPER MACHINES AND METHOD FOR MANUFACTURING THE SAME

[75] Inventor: Veijo Miihkinen, Jyväskylä , Finland

[73] Assignee: Valmet Paper Machinery Inc., Finland

[21] Appl. No.: 816,628

[22] Filed: Jan. 6, 1986

[30] Foreign Application Priority Data

Jan. 9, 1985 [FI] Finland ..... 850107

[51] Int. Cl.[5] ..... B21D 53/00

[52] U.S. Cl. ..... 29/895.211; 29/130; 29/132; 164/98; 427/135; 427/436

[58] Field of Search ..... 29/132, 130, 458, 527.2, 29/140.4 D; 427/34, 53.1, 133, 135, 178, 421, 423, 436; 100/155 R; 164/98

[56] References Cited

U.S. PATENT DOCUMENTS

| | | | |
|---|---|---|---|
| 4,060,882 | 12/1977 | Pospisil et al. | 29/132 |
| 4,137,106 | 1/1979 | Doi et al. | 29/132 |
| 4,165,407 | 8/1979 | Endoh et al. | 29/132 |
| 4,368,568 | 1/1983 | Watanabe | 29/132 |
| 4,391,829 | 7/1983 | Fabian et al. | 29/132 |
| 4,466,164 | 8/1984 | Tadokoro et al. | 29/132 |
| 4,518,655 | 5/1985 | Henry et al. | 29/132 |
| 4,522,866 | 6/1985 | Nishikawa et al. | 29/132 |

OTHER PUBLICATIONS

Metals Handbook, vol. 8, Metallography, Structures and Phase Diagrams, 8th Edition, 1973, p. 248, 321.

*Primary Examiner*—Howard N. Goldberg
*Assistant Examiner*—I. Cuda
*Attorney, Agent, or Firm*—Steinberg & Raskin

[57] ABSTRACT

A synthetic press roll for use in paper machines includes a cylindrical mantle to which a surface layer is applied, the surface layer comprising a mixture of a first powder of metallic material and a second powder of an inorganic material. The metallic material of the first powder includes copper, bronze, stainless steel, nickel, chromium and/or a titanium alloy. The inorganic material of the second powder comprises quartz, feldspar, $Al_2O_3$, $ZrO_2$, $TiO_2$, TiC, SiC, MgO, $Si_3N_4$, $Cr_2O_3$, WC, NbC, VC, $Cr_7C_3$, or other corresponding ceramic material, or mixtures of the same. The surface layer may be produced by thermal spraying, casting, by winding a sintered or rolled band of the mixture around the mantle, or by forming a flexible mat pre-coating in which the desired mixture is bound by a binder, such as PTFE, and by fixing the precoating to the roll mantle by melting it by means of induction or laser heating. A press roll in accordance with the invention provides a controlled detachment of the paper web from the roll and is more resistant to variations in temperature and to mechanical strains than conventional press rolls.

17 Claims, No Drawings

SYNTHETIC PRESS ROLL FOR PAPER MACHINES AND METHOD FOR MANUFACTURING THE SAME

BACKGROUND OF THE INVENTION

The present invention relates generally to paper making and, more particularly, to synthetic press rolls for use in paper machines and to methods for manufacturing such synthetic press rolls.

Rock rolls used in paper machine press sections are formed of granite for the reason that the surface properties of granite provide for a controlled detachment of the paper web from the surface of the rock roll. Granite also provides good resistance to the abrasive effects of a doctor.

However, granite does have some drawbacks. Being a natural material, its properties tend to vary which may result in non-uniform, and in certain cases even inadequate, detachment of the web from the surface of the roll. Internal flaws may exist in the granite material which result in a tendency for the roll to crack. Indeed, this tendency to crack constitutes the most serious problem in applications where the rock roll is subjected to high linear loads at high temperatures, such as where it is attempted to increase the dry solid content of the paper in the press section of the paper machine. It is advantageous to increase the dry solid content of a web in the press section of a paper machine since this is significantly more economical than dewatering a web by evaporation. Moreover, a web which has been dewatered to a greater extent in the paper machine permits the running speed of the paper machine to be increased, and the most natural way of increasing the dry solid content of the web is to increase the linear load and the temperature at the press section. However, this has not been possible to the extent desired using conventional rock rolls. Another disadvantage of conventional rock rolls is that they are heavy components which increase the tendency for the paper machine to oscillate during operation. The great weight of rock rolls also requires more extensive frame constructions for the paper machine.

Conventional rock rolls generally comprise a relatively thick cylindrical mantle of granite inside of which a steel shaft is situated. Tensioning flanges are attached at the ends of the steel shaft by means of which the granite mantle is compressed to eliminate the possibility of tensile loads acting on the mantle under any loading condition. Such construction is relatively complicated and it is desirable in any modification of a press roll to retain such basic construction.

Attempts have been made to provide synthetic rock rolls. Generally, such rolls are provided with a polymer surface to which a rock powder, such as quartz sand, has been added to hard rubber or polyurethane. These prior art synthetic rock rolls have the drawback that the paper web has a tendency to adhere excessively to the surface of the roll and, moreover, the roll has poor strength properties. In particular, the use of such polymer-surfaced rolls at elevated temperatures, such as above 80° C., has not been possible.

SUMMARY OF THE INVENTION

Accordingly, it is an object of the present invention to provide a new and improved synthetic press roll and a method for manufacturing the same having surface properties by which detachment of the paper web from the roll surface is controlled and which provides a higher resistance to temperature and to mechanical strains than has been possible heretofore.

Another object of the present invention is to provide new and improved synthetic press rolls and methods for manufacturing the same with which roll bodies, e.g. roll mantles, manufactured in accordance with conventional casting techniques can be used.

Briefly, in accordance with the present invention, these and other objects are attained by providing a press roll for use in a paper machine comprising a cylindrical mantle having a surface layer comprising a mixture of a first powder of metallic material and a second powder of inorganic material.

In accordance with the invention, the roll can be manufactured by several different methods.

According to a first method, a press roll in accordance with the invention is manufactured by applying a surface layer comprising the mixture onto the roll body, e.g. the roll mantle, by thermal spraying.

According to a second method of the invention, the surface layer is produced by casting the mixture and then applying the cast surface layer onto the roll body.

According to a third method of the invention, the surface layer is produced by winding a sintered and/or rolled band of the mixture onto the roll mantle.

According to a fourth method of the invention, the surface layer is produced by preparing a pre-coating comprising a flexible mat formed of the mixture and a binder, such as PTFE or the like, and then fixing the pre-coating to the roll body by melting the same using induction heating, laser heating, or some other type of suitable heating technique.

The function of the first powder of metallic material is to act as a binder agent and to increase the toughness of the roll coating. The function of the second powder of inorganic material is to produce a wear-resistant surface of suitable surface energy. In this connection, the surface energy of the roll surface must be within certain limits in order to control the detachment of the paper web from the surface of the press roll. The surface energy of granite, whose surface properties provide a desirable controlled detachment of the paper web from the roll surface, will vary as a function of the roughness of the surface so that a granite roll operates in a desired manner when the surface energy is within the range of between about 41 to 50 $mJ/m^2$. The total surface energy is in fact divided between two components, namely, a dispersion component and a polarity component. The dispersion component of granite is about 32 to 33 $mJ/m^2$ and its polarity component varies in the range of between about 9 and 19 $mJ/m^2$, depending upon the roughness of the surface.

Besides the material from which the surface layer of the roll is made, another factor which affects the surface energy is the ratio of hydrophilic components in the surface to the hydrophobic components in the surface. In particular, hydrophilic and hydrophobic components exist in the paper web and in the surface layer of a roll in accordance with the invention. Since hydrophilic material repels hydrophobic material and vice versa, a controlled detachment of the web from the surface of the roll can be obtained by mixing hydrophilic and hydrophobic material in an appropriate ratio so that the surface energy of the press roll remains within the desired range. Thus, by providing a press roll with a surface layer in accordance with the invention, it is possible to adjust the surface energy of the roll in a more accurate manner than has been possible heretofore.

DESCRIPTION OF THE PREFERRED EMBODIMENTS

In the construction of a press roll in accordance with the invention, the surface layer or coating to be applied to the roll body, e.g., the cylindrical roll mantle, is prepared by any one of the methods described below. The roll bodies are manufactured in a conventional manner such, for example, as by casting. The roll body includes axle journals at its ends and is the principal component that provides the roll with the necessary mechanical strength to withstand loading in a press nip. The desired surface properties of the cylinder mantle and the mechanical strength of the surface are provided by means of the roll coating or surface layer in accordance with the invention.

In accordance with one method of the invention, the surface layer is applied to the roll body by thermal spraying. A mixture of a first powder of metallic material and a second powder of inorganic material is prepared. The first powder of metallic material comprises a powder of copper. The second powder comprises ceramic material, such as $Al_2O_3$, $SiO_2$, $TiO_2$, $ZrO_2$ or SiC. The surface energy of copper is 39.4 $mJ/m^2$, the dispersion component being 36.4 $mJ/m^2$, and the polarity component being 2.9 $mJ/m^2$. It is seen that copper is a hydrophobic component. The particle size of the copper powder varies within the range of between about 5 to 40 um and the particle size of the ceramic materials, such as $A1_2O3$, varies within the range of between about 40 to 100 um. The particle size of $Al_2O_3$ is larger than the particle size of the copper so that the weight of the copper particles and the $Al_2O_3$ particles are within the same range. In this manner, it is possible to avoid separation of the first and second powder components of the mixture during spraying. The quantity of the ceramic powder may vary within a range of between about 10 to 90 parts by volume of the total volume of the mixture, a typical mixing ratio being 30 parts by volume of copper and 70 parts by volume of $Al_2O_3$. The first powder may also be formed of bronze, nickel and/or alloys of chromium and nickel instead of copper. Thermally sprayable powders may also be prepared wherein the powder components are bound to each other. Such powders comprising a mixture of metal and ceramic powders are referred to as cermet.

In accordance with a second method of the invention, a surface layer comprising a mixture of a metallic powder and a powder of inorganic material is formed and applied to the roll body by a casting technique. For example, the roll coating may be produced by centrifugal casting. The powder of inorganic material comprises a ceramic powder which is chosen to have a density that is substantially equal to or slightly greater than the density of the metallic powder. For example, if the metallic powder comprises copper having a density of 8.96 $g/cm^3$, the inorganic powder can be chosen, for example, from a group consisting of $W_2C$, WC, TaC, $Mo_2C$, NbC, whose densities are 17.2, 15.7, 14.5, 9.2, and 7.8 $g/cm_3$ respectively. In this manner the ceramic material will be well distributed throughout the surface layer. The surface layer of the press roll may also be cast in a continuous process in a vertical position in which case the inorganic material is deposited as a powder onto the surface of the melt at the same time. The cold powder accelerates the crystallization of the melt and the powder will be uniformly distributed in the metal component.

According to a third method of the invention, the roll coating or surface layer is produced by preparing a sintered band. In particular, the desired mixture of powders is compacted into a band by rolling whereupon the band is sintered and then wound under tensile stress around the roll cylinder to form the desired surface layer.

According to a fourth method of the invention, a roll coating is produced using, for example, the Conforma-Clad process of Imperial Clevite, Corp. In this method, the desired mixture of powders is itself mixed with a binder, such as PTFE, in a mill to form a flexible cloth-type pre-coating. The pre-coating is wound around the roll body and is fixed thereto by melting the same. In order to melt the precoating, induction or laser heating may be used although other heating techniques may be utilized.

Obviously, numerous modifications and variations of the present invention are possible in the light of the above teachings. It is therefore to be understood that within the scope of the claims appended hereto, the invention may be practiced otherwise than as specifically disclosed herein.

What is claimed is:

1. A press roll for use in paper machine, comprising:

a cylinder mantle having a surface layer defining an outer surface of said press roll, said surface layer comprising a mixture of first metal particles and second particles of an inorganic compound, said first and second particles being dispersed throughout said surface layer.

2. The combination of claim 1 wherein said metal of said first particles includes copper.

3. The combination of claim 1 wherein said metal of said first particles includes bronze.

4. The combination of claim 1 wherein said metal of said first particles includes at least one of stainless steel, nickel, chromium, and titanium alloy.

5. The combination of claim 1 wherein said inorganic compound of said second particles includes a ceramic compound.

6. The combination of claim 1 wherein said inorganic compound of said second particles includes at least one of quartz, feldspar, $Al_2O_3$, $ZrO_2$, $TiO_2$, TiC, SiC, MgO, $Si_3N_4$, $Cr_2O_3$, WC, NbC, VC, $Cr_7C_3$.

7. The combination of claim 1 wherein said second particles of inorganic compound comprise about 10 to 90 parts by volume of the overall volume of said mixture.

8. The combination of claim 1 wherein said second particles of inorganic compound have a size in the range of between about 5 to 500 um.

9. A method of manufacturing a press roll for use in a paper machine, said press roll including a roll body, comprising the steps of:

preparing a mixture of first metal particles and second particles of an inorganic compound; and providing said roll body with a surface layer by applying said mixture onto said roll body with said first and second particles being dispersed throughout said surface layer.

10. The method of claim 9 wherein said surface layer is applied to said roll body by thermal spraying said mixture onto said roll body.

11. The method of claim 9 wherein said surface layer is applied to said roll body by casting.

12. The method of claim 9 wherein said surface layer is applied to said roll body by forming said mixture into a sintered or rolled band and winding said band around said roll body.

13. The method of claim 9 wherein said surface layer is applied to said roll body by preparing a pre-coating comprising a flexible mat formed of said mixture and a binder and fixing said pre-coating to said roll body by melting the same.

14. The method of claim 13 wherein said binder is PTFE.

15. The method of claim 13 wherein said pre-coating is melted by heating the same using one of inductive heating and laser heating.

16. The combination of claim 1, wherein said surface layer has a surface energy of about 41 to 50 $mJ/m^2$.

17. The method of claim 9 wherein a surface layer having a surface energy of about 41 to 50 $mJ/m^2$ is produced.

* * * * *